US010123594B2

(12) United States Patent
Rafaelian

(10) Patent No.: US 10,123,594 B2
(45) Date of Patent: Nov. 13, 2018

(54) SLIDER ELEMENTS FOR ARTICLES OF JEWELRY

(71) Applicant: Alex and Ani, LLC, Cranston, RI (US)

(72) Inventor: Carolyn A. Rafaelian, Cranston, RI (US)

( * ) Notice: Subject to any disclaimer, the term of this patent is extended or adjusted under 35 U.S.C. 154(b) by 24 days.

(21) Appl. No.: 14/821,025

(22) Filed: Aug. 7, 2015

(65) Prior Publication Data

US 2017/0035159 A1 Feb. 9, 2017

(51) Int. Cl.

| | |
|---|---|
| ***A44C 5/22*** | (2006.01) |
| *A44C 15/00* | (2006.01) |
| *A44C 5/00* | (2006.01) |
| *A44C 11/00* | (2006.01) |

(52) U.S. Cl.

CPC ..... *A44C 5/22* (2013.01); *A44C 5/0053* (2013.01); *A44C 11/005* (2013.01); *A44C 15/005* (2013.01); *A44C 15/0085* (2013.01)

(58) Field of Classification Search

CPC ..... A44C 5/22; A44C 5/0069; A44C 15/0085; A44C 15/005; A44C 11/005; F16G 11/048; F16G 11/14; F16G 11/103; Y10T 24/39; Y10T 24/3916; Y10T 24/3936; Y10T 24/49; Y10T 24/492; Y10T 24/497; Y10T 24/44538; Y10T 24/3987; Y10T 24/3991; Y10T 24/47; Y10T 24/4736; Y10T 24/4755; Y10T 24/4764; Y10T 24/4773

USPC ..... 63/3.1, 3.2, 11, 5.1; 24/115 H, 265 EC, 24/129 R, 132 R

See application file for complete search history.

(56) References Cited

U.S. PATENT DOCUMENTS

| | | | | |
|---|---|---|---|---|
| 80,676 | A * | 8/1868 | Soule | A44B 11/24 24/115 H |
| D14,438 | S | 11/1883 | Ahn | |
| 434,220 | A | 8/1890 | Whitney | |
| 895,078 | A | 8/1908 | Doppenschmitt | |
| 993,303 | A | 7/1910 | Kirby | |
| 1,689,251 | A | 10/1928 | Ogush | |
| 1,708,470 | A | 4/1929 | Eckert et al. | |
| 2,263,956 | A | 11/1941 | Russell | |
| 2,325,712 | A | 8/1943 | Shurmur | |
| 2,484,200 | A | 10/1949 | Werntz | |
| 2,492,393 | A | 12/1949 | Muray | |
| 2,637,884 | A | 5/1953 | Morehouse | |

(Continued)

FOREIGN PATENT DOCUMENTS

| | | | | |
|---|---|---|---|---|
| FR | 641676 A | * | 8/1928 | A44C 5/22 |
| GB | 2 122 873 A | | 1/1984 | |

(Continued)

OTHER PUBLICATIONS http://www.rings-things.com/blog/2011/06/23-how-to-make-a-sliding-adjustable-necklace (Last accessed Dec. 12, 2014).

(Continued)

*Primary Examiner* — Jack W Lavinder

(57) ABSTRACT

A slider for an article of jewelry is disclosed. The slider includes a body defining a securing channel and a sliding channel. The slider also includes a securing flap extending from the body and configured to be pressed from a first position to a second position such that the securing flap is pressed at least partially into the securing channel to restrain the band when the band is disposed therein. Articles of jewelry utilizing such sliders are also disclosed herein.

20 Claims, 6 Drawing Sheets

(56) References Cited

U.S. PATENT DOCUMENTS

| | | | | |
|---|---|---|---|---|
| 3,217,514 | A | 11/1965 | Newman | |
| 3,675,277 | A | 7/1972 | Day | |
| 3,837,608 | A | 9/1974 | Simon | |
| 3,872,833 | A | 3/1975 | Herbert | |
| D256,789 | S | 9/1980 | Mazzini | |
| D256,899 | S | 9/1980 | Mazzini | |
| 4,334,413 | A | 6/1982 | Gaston et al. | |
| D267,159 | S | 12/1982 | Borofksy et al. | |
| 4,499,634 | A | 2/1985 | Zimmardi | |
| D305,611 | S | 1/1990 | Herzog | |
| 4,996,948 | A | 5/1991 | Klein et al. | |
| 5,307,582 | A | 5/1994 | Quintel | |
| 5,440,789 | A * | 8/1995 | Lofland | F16G 11/101 24/132 R |
| 5,979,095 | A * | 11/1999 | Schneider | G09F 3/005 24/704.1 |
| 6,044,527 | A * | 4/2000 | Ishida | F16G 11/101 24/115 F |
| 6,170,250 | B1 | 1/2001 | Hara et al. | |
| 6,618,910 | B1 * | 9/2003 | Pontaoe | F16G 11/14 24/115 H |
| 6,641,100 | B2 | 11/2003 | Furukawa | |
| D522,351 | S | 6/2006 | Taylor | |
| 7,066,113 | B2 | 6/2006 | Cheng et al. | |
| 7,237,307 | B2 * | 7/2007 | Feschuk | F16G 11/14 24/115 R |
| D644,551 | S | 9/2011 | Aug et al. | |
| D663,232 | S | 7/2012 | Rafaelian | |
| D663,233 | S | 7/2012 | Rafaelian | |
| D664,466 | S | 7/2012 | Rafaelian | |
| D678,102 | S | 3/2013 | Rafaelian | |
| 8,590,341 | B2 | 11/2013 | MacMaster | |
| D703,088 | S | 4/2014 | Fiasconaro | |
| D704,085 | S | 5/2014 | DiPietro | |
| D707,150 | S | 6/2014 | Pugnet | |
| D716,175 | S | 10/2014 | Rosenel | |
| D724,470 | S | 3/2015 | Rafaelian | |
| D724,473 | S | 3/2015 | Blondet | |
| D724,985 | S | 3/2015 | Blondet | |
| D724,986 | S | 3/2015 | Blondet | |
| D738,773 | S | 9/2015 | Rafaelian | |
| D749,452 | S | 2/2016 | Butler | |
| 9,301,580 | B1 | 4/2016 | Rafaelian | |
| D759,532 | S | 6/2016 | Mazza | |
| D781,742 | S | 3/2017 | Rafaelian | |
| 2006/0000116 | A1 | 1/2006 | Brewer | |
| 2008/0245048 | A1 | 10/2008 | Moore | |
| 2011/0314866 | A1 | 12/2011 | Niikura | |
| 2014/0014693 | A1 | 1/2014 | Korotkina | |
| 2014/0090215 | A1 | 4/2014 | Lixenberg | |
| 2015/0320152 | A1 | 11/2015 | Rafaelian | |
| 2015/0359301 | A1 | 12/2015 | Lavorato et al. | |

FOREIGN PATENT DOCUMENTS

| | | | |
|---|---|---|---|
| JP | D1177437 | S | 6/2003 |
| JP | D1268404 | S | 4/2006 |
| JP | 1467955 | S | 5/2013 |
| JP | 1467957 | S | 5/2013 |
| JP | D1496501 | S | 5/2014 |
| KR | 3008138520000 | | 9/2005 |

OTHER PUBLICATIONS http://www.icecarats.com/Sterling-Silver-Black-Leather-Expandable-Cord-Bracelet-312709 (Last accessed Dec. 12, 2014).

* cited by examiner

SLIDER ELEMENTS FOR ARTICLES OF JEWELRY

BACKGROUND

1. Field of the Disclosure

Embodiments of this disclosure generally relate to articles of jewelry, more particularly to slider elements for use in adjustable articles of jewelry.

2. Background of the Related Art

Certain articles of jewelry are expandable or adjustable and include one or more sliders configured to retrain a portion of a band and allow another portion to slide therethrough. Traditional bands are glued into a first hole of the slider at one end thereof then passed back through another hole in the slider to allow the band to slide therethrough. The other end of the band can be secured to a second slider in a similar manner.

Such traditional devices have been considered satisfactory for their intended purpose, however, such devices require additional labor and time to assemble onto a band and can be expensive to produce as a result. The slider elements described in this disclosure provide solutions for the above problems.

SUMMARY OF THE INVENTION

The purpose and advantages of the embodiments of this disclosure will be set forth in and apparent from the description that follows. Additional advantages of the embodiments of this disclosure will be realized and attained by the devices, systems and methods particularly pointed out in the written description and claims hereof, as well as from the appended drawings.

To achieve these and other advantages, the present disclosure is directed to, in one aspect, a slider for an article of jewelry. The slider includes a body, among other elements, the defines a securing channel and a sliding channel. A securing flap extends from the body of the slider and is configured to be pressed from a first position to a second position such that the securing flap is pressed at least partially into the securing channel to restrain the band when the band is disposed therein.

In certain embodiments, the securing flap can include one or more protrusions extending therefrom. In the second position, the one or more protrusions can be configured to pierce into the band. For example, the one or more protrusions can include a plurality of conical teeth.

The sliding channel can be parallel with the securing channel. In certain embodiments, the sliding channel can include a frictional layer to resist sliding of the band. Additionally or alternatively, the sliding channel can be sized to be smaller than the band to resist sliding via compressive forces from walls that define the securing channel.

The body and/or the securing flap can be made of metal or any other suitable material. In certain embodiments, the body and the securing flap are integrally formed. It is contemplated that the slider can be made via any suitable method (e.g., casting, additive manufacturing, milling).

The securing channel can be longitudinally defined through an entire length of the body and the securing flap can be defined from an end of the body along a portion of a longitudinal length of the body. In certain embodiments, the securing flap can be defined in a middle portion of the body over the securing channel and along a portion of a longitudinal length of the body.

In accordance with at least one aspect of this disclosure, an article of jewelry can include a band and a slider as described herein, wherein the securing flap is pressed into the securing channel such that the securing flap compresses against the band therein. A second slider can be disposed on the band. The second slider can be the same as the first slider or can be any other suitable slider.

The article of jewelry can be at least one of a necklace, a bracelet, an anklet, or any other suitable article of jewelry. In certain embodiments, the band can be sized to be larger than the sliding channel to reduce sliding via compressive forces from walls that define the securing channel pressing against the band.

In accordance with at least one aspect of this disclosure, a method for manufacturing adjustable jewelry can include disposing a band within a securing channel of a slider element and pressing a securing flap onto the band to secure the band within the securing channel.

These and other features of the embodiments of this disclosure will be described further herein below.

BRIEF DESCRIPTION OF THE DRAWINGS

So that those having ordinary skill in the art to which this disclosure pertains will more readily understand how to employ the systems and methods of this disclosure, embodiments thereof will be described in detail hereinbelow with reference to the drawings, wherein.

These and other aspects of the subject disclosure will become more readily apparent to those having ordinary skill in the art from the following detailed description of the invention taken in conjunction with the drawings.

DETAILED DESCRIPTION OF CERTAIN EMBODIMENTS

Embodiments of this disclosure are now described more fully with reference to the accompanying drawings, in which an illustrated embodiment is shown. This disclosure is not limited in any way to the illustrated embodiments as the illustrated embodiments described below are merely examples which can be embodied in various forms, as appreciated by one skilled in the art. Therefore, it is to be understood that any structural and functional details disclosed herein are not to be interpreted as limiting, but merely as a basis for the claims and as a representative for teaching one skilled in the art to variously employ the embodiments disclosed herein. Furthermore, the terms and phrases used herein are not intended to be limiting but rather to provide an understandable description of the embodiments herein.

Figure 1:
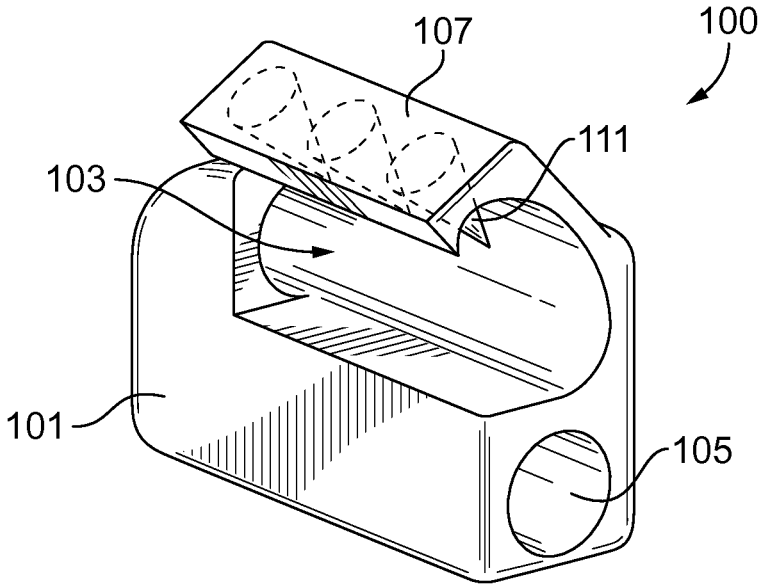
FIG. 1 is a perspective view of an embodiment of a slider constructed in accordance with this disclosure, showing a securing flap extending from an end thereof.
Figure 2:
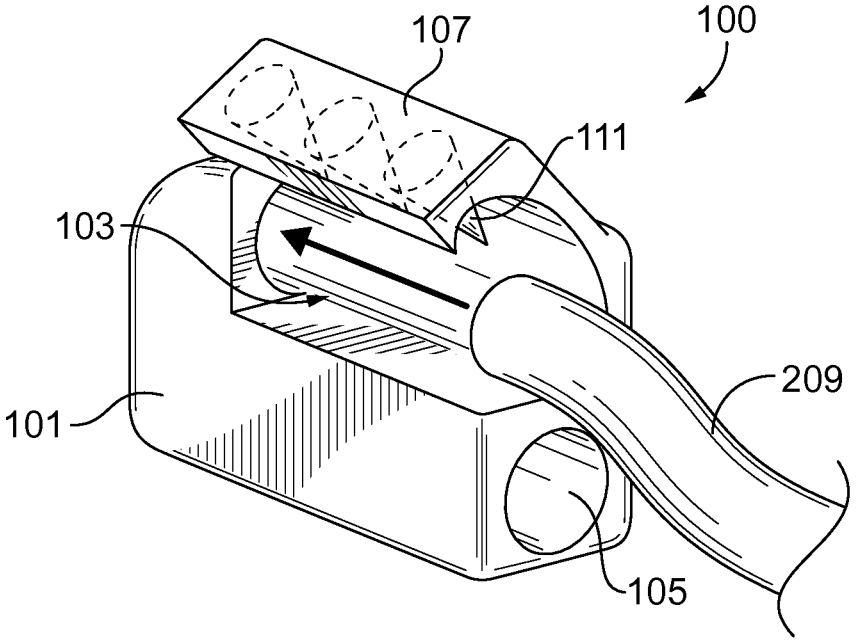
FIG. 2 illustrates an article of jewelry being inserted into a securing channel of the slider of FIG. 1.
Figure 3:
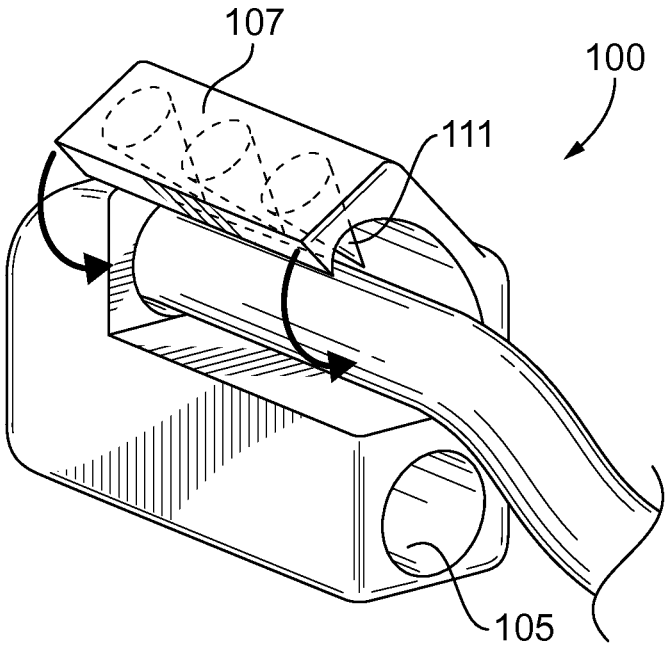
FIG. 3 illustrates a securing flap of the slider of FIG. 1 being pressed into the band that is placed in the securing channel.
Figure 4:
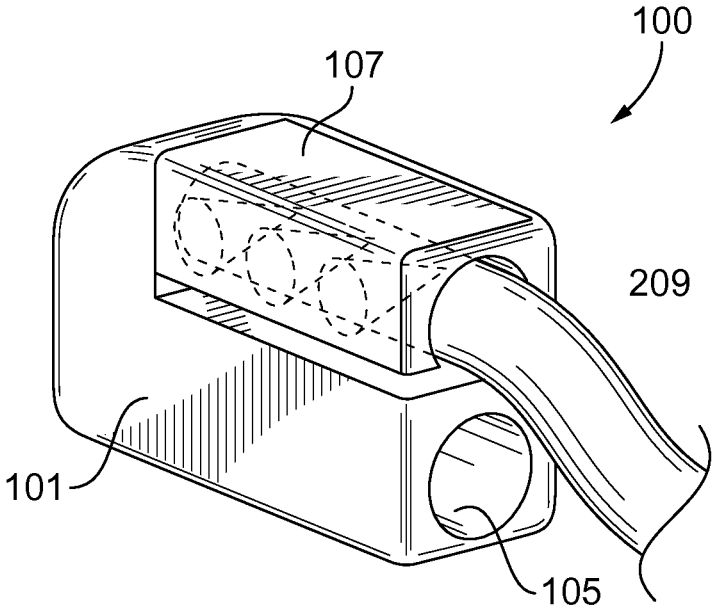
FIG. 4 illustrates the securement flap compressing the band within the securing channel of the slider of FIG. 1.
Figure 5:
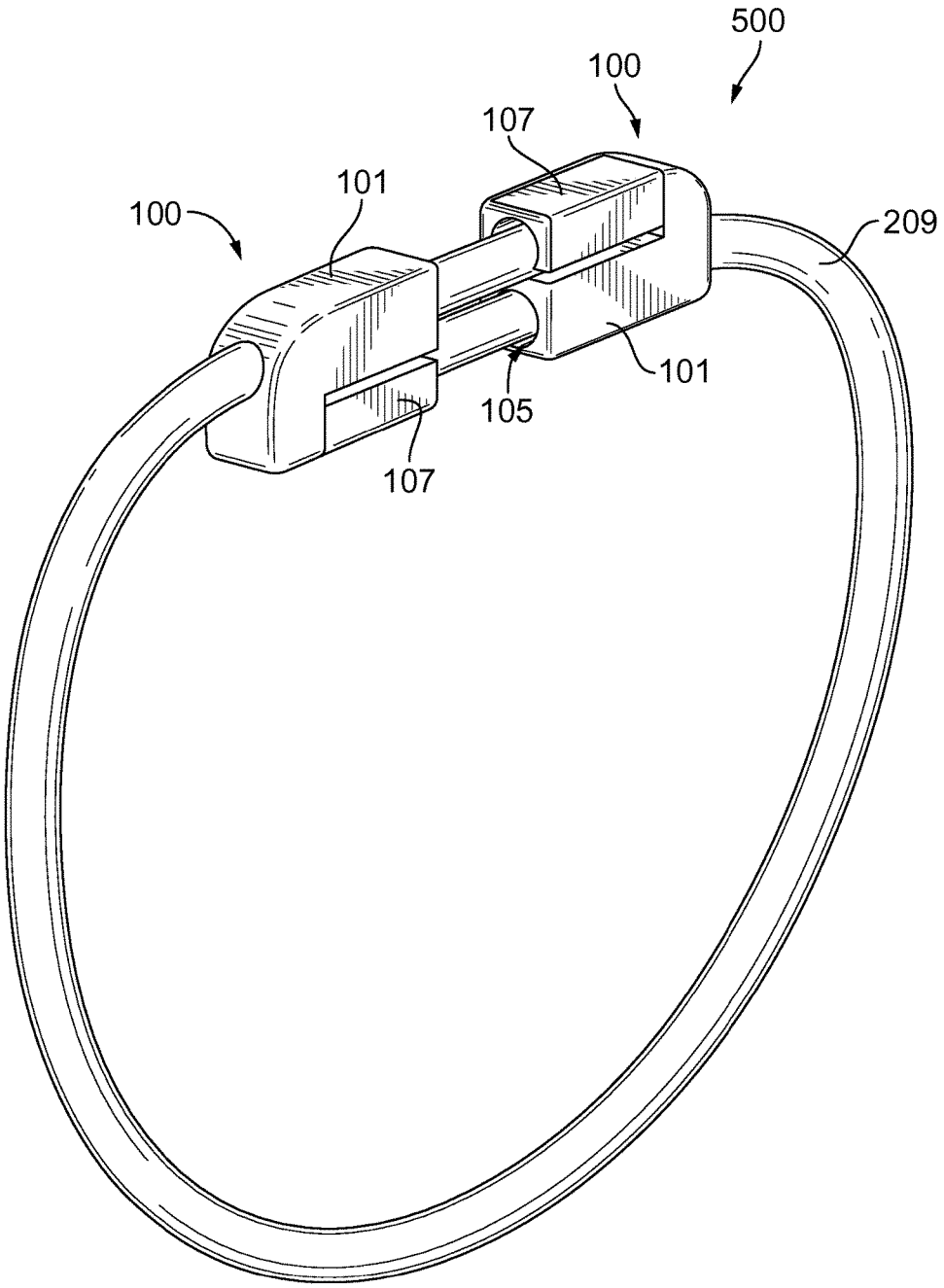
FIG. 5 illustrates a band utilizing a slider as shown in FIG. 1.
Figure 6:
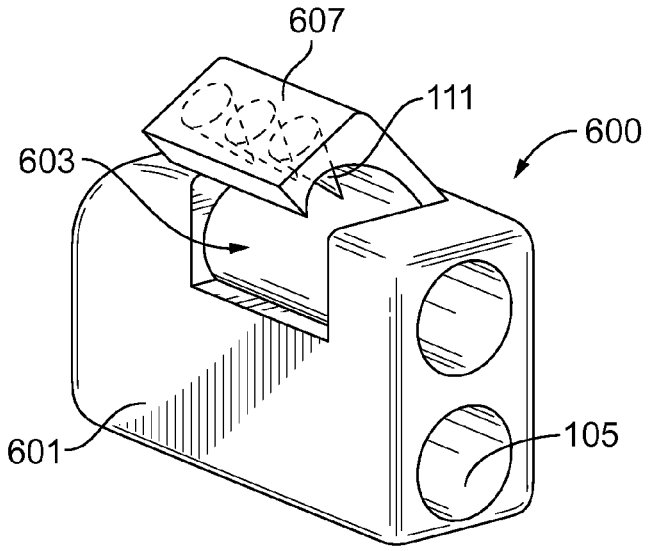
FIG. 6 is a perspective view of a further embodiment of a slider that is constructed in accordance with the present disclosure, showing a securing flap extending therefrom.
Figure 7:
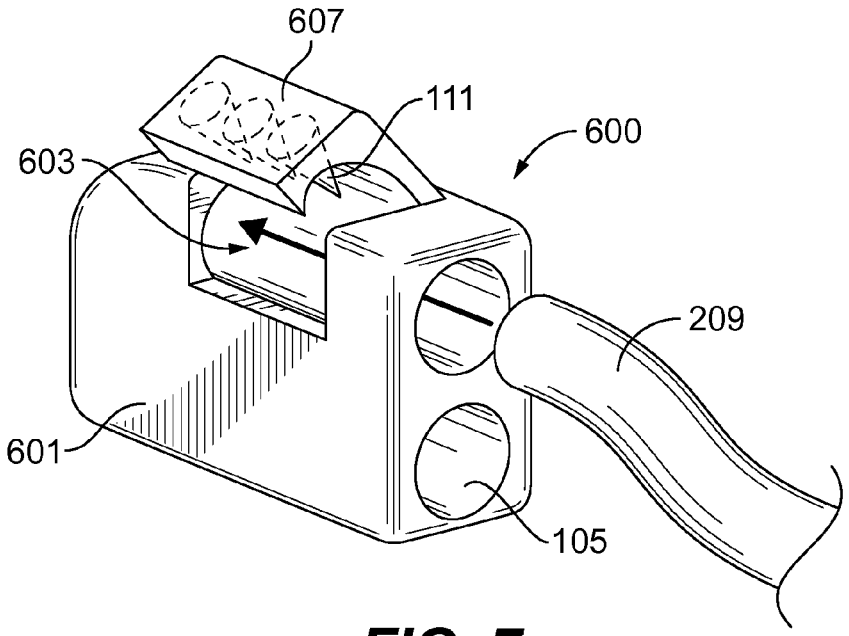
FIG. 7 illustrates a band being inserted into a securing channel of the slider of FIG. 6.
Figure 8:
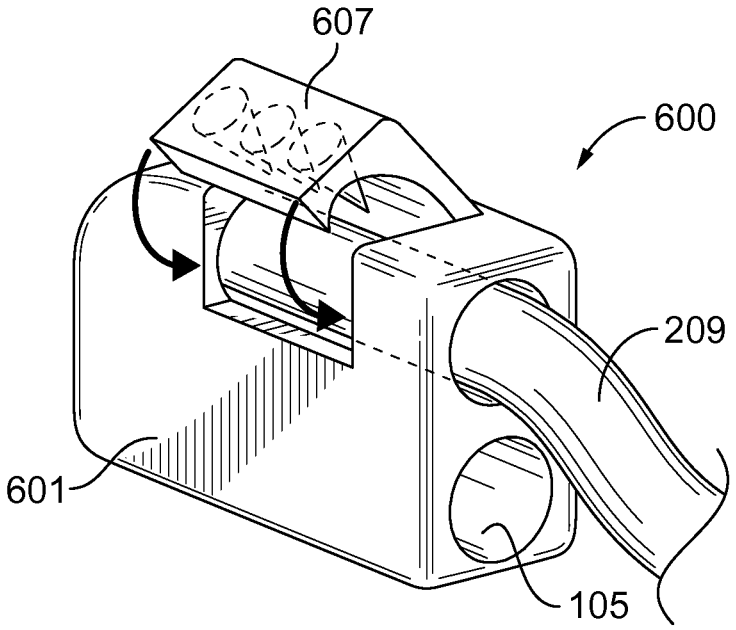
FIG. 8 illustrates a securing flap of the slider of FIG. 6 being pressed into the band that is placed in the securing channel.
Figure 9:
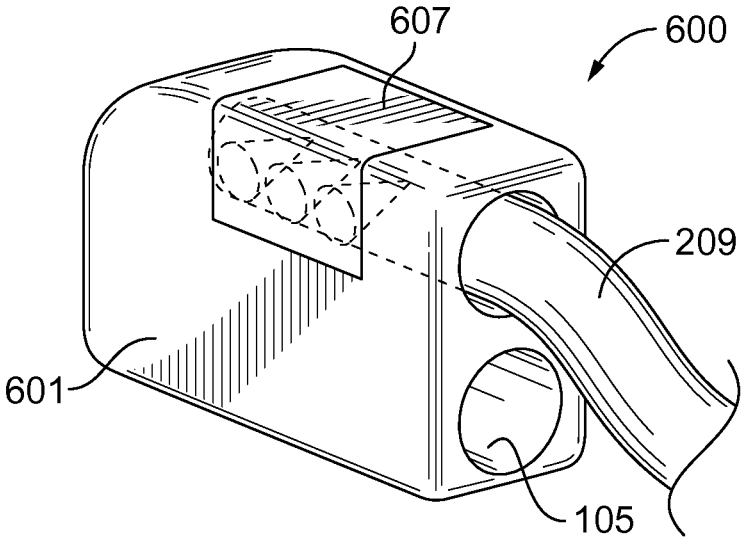
FIG. 9 illustrates the securement flap compressing the band within the securing channel of the slider of FIG. 6.

Turning now descriptively to the drawings, in which similar reference characters denote similar elements throughout the several views, FIGS. 1-4 depict an embodiment of a slider 100 for an article of jewelry (e.g., as shown in FIG. 5). The slider 100 includes a body 101 defining a securing channel 103 and a sliding channel 105.

In certain embodiments, the sliding channel 105 can include a frictional layer (not shown) having a frictional material which is adapted and configured to resist motion of the band 209 within the sliding channel 105. The friction layer can allow the band 209 to be selectively slid through the sliding channel 105 when a force sufficient to overcome a frictional force provided by the frictional material is applied thereto.

The frictional material can include a semi-rigid material disposed within the cavity or channel on the inner surface of the bead. In some embodiments, the frictional material includes a rubber and/or a plastic. In certain embodiments, the frictional material can include silicone or any suitable polymer.

Additionally or alternatively to having a frictional layer, the sliding channel 105 can be sized to be smaller than the band 209 to resist sliding via compressive forces from the securing channel 105 pressing against the band 209.

The slider 100 also includes a securing flap 107 extending from the body 101 and configured to be pressed into the securing channel 103 to restrain the band 209 that is disposed in the securing channel 103. In the embodiment shown in FIGS. 1-4, the securing flap 107 includes one or more protrusions 111 extending therefrom.

The protrusions 111 can be configured to pierce into the band 209. For example, the protrusions 111 can include a plurality of conical teeth. Any other suitable size or shape protrusions 111 and/or combinations thereof are contemplated herein. It is contemplated herein that the protrusions 111 can be made of any suitable material (e.g., metal, a suitable elastic material) and can be integral or separately attached to the securing flap 107. For example, the securing flap 107 may be made of metal, but the protrusions 111 may be made from rubber or other suitable soft material which can be beneficial in embodiments where the band 209 is a metal chain.

The protrusions 111 can be defined on any suitable internal surface of the securing flap 107. For example, as shown, the securing flap 107 can be bent to define surfaces with multiple directions. The protrusions 111 can extend from one of more of these portions of the securing flaps (e.g., before the bend, after the bend as shown, on the bend).

It is also contemplated that, in addition to or alternatively to the protrusions 111, a frictional material (not shown) can be disposed on the securing flap 107 to facilitate retaining a portion of a band 209 therein.

As shown, the body 101 and/or the securing flap 107 can be made of metal, but any other suitable material is contemplated herein. As shown, in certain embodiments, the body 101 and the securing flap 107 are integrally formed. However, it is contemplated that the slider 100 can be made via and suitable method (e.g., casting, additive manufacturing, milling) and the securing flap 107 can be attached to the body 101 in any other suitable manner (e.g., welding, spring biased to compress against a band 209). While the body 101 is shown having a curved exterior shape on at least one portion thereof, any suitable exterior shape (functional and/or aesthetic) of the body 101 is contemplated herein.

As shown in FIGS. 1-5, the securing flap 107 can be defined from or found adjacent to an end of the securing channel 105 along a portion of the longitudinal length of the body 101. Referring to FIGS. 6-10, in certain embodiments, a slider 600 can include a securing flap 607 that can be defined in a middle portion of the body 601 over the securing channel 603 and along a portion of the longitudinal length of the body 601. The slider 600 can otherwise include similar features as slider 100 described above.

As described above, the securing flap 107, 607 allows for a band 209 to be inserted into the securing channel 103, 603 and to be secured to the slider 100, 600 by pressing/crimping the securing flap 107, 607 into the securing channel 103, 603. Such pressing/crimping can plastically deform the securing flap 107, 607 where it is attached (e.g., via a living hinge) to the body 101, thereby allowing the securing flap 107, 607 to retain a pressed in state against a band 209. Also, protrusions 111 can pierce into the band 209 enhancing the retention of the band 209 in addition to the force of compression from the securing flap 107, 607.

Figure 10:
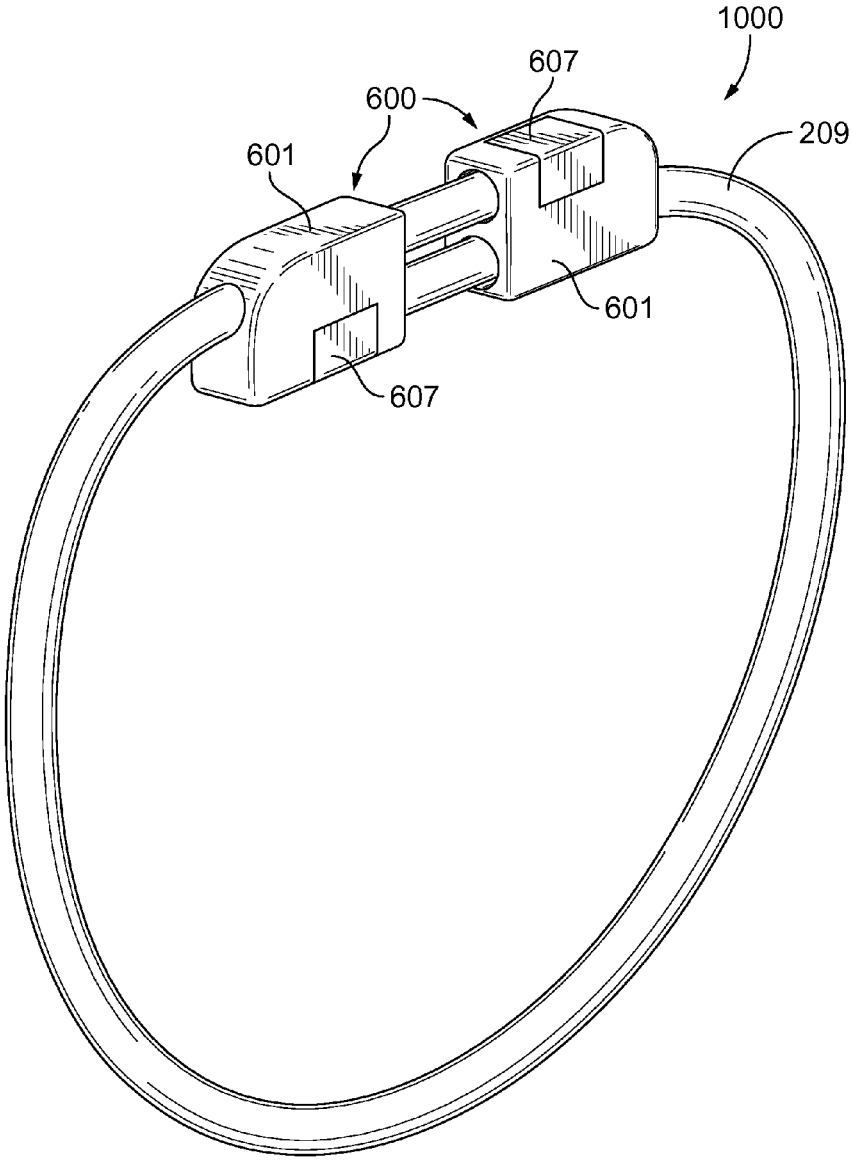
FIG. 10 illustrates an article of jewelry utilizing a slider as shown in FIG. 6.

Referring to FIGS. 5 and 10, an article of jewelry 500, 1000 can include a band 209 and a slider 100, 600 as described hereinabove. The article of jewelry 500, 1000 can be any suitable adjustable article of jewelry (e.g., a bracelet, necklace, or anklet). The band 209 can be made of any suitable material (e.g., cloth, leather, chain). The securing flap 107, 607 is pressed into the securing channel 103, 603 such that the securing flap 107,607 compresses against the band 209 within the securing channel 103, 603 to secure the band 209 within the securing channel 103, 603.

As shown, a second slider 100, 600 can be disposed on the band 209. While the second slider 100, 600 is shown as being substantially the same as the first slider 100, 600, it is contemplated that any other suitable slider can be used in conjunction with one or more slider 100, 600 as described above. As shown, the article of jewelry 500, 1000 are expandable as two ends of the band 209 are secured within the sliders 100, 600 while portions of the band 209 are slidably placed through the sliding channels 105 of each slider 100, 600.

The diameter of the sliding channel 105, the diameter of the band 209, and/or a frictional coating on an interior of the sliding channel 105 can be selected such that sliding is prevent below a threshold application of force in order to allow the band 209 to be secured into a desired position by the user. In this regard, a user can pull the band 209 through the sliding channels 105 to change a size defined by the band 209 and the band 209 can maintain its position because it is restricted from sliding freely.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the disclosed embodiments, exemplary methods and materials are now described. All publications mentioned herein are incorporated herein by reference to disclose and describe the methods and/or materials in connection with which the publications are cited.

It must be noted that as used herein and in the appended claims, the singular forms "a", "an," and "the" include plural referents unless the context clearly dictates otherwise. Thus, for example, reference to "a stimulus" includes a plurality of such stimuli and reference to "the signal" includes reference to one or more signals and equivalents thereof known to those skilled in the art, and so forth.

The descriptions above and the accompanying drawings should be interpreted in the illustrative and not the limited sense. While the invention has been disclosed in connection with the embodiments disclosed herein, it should be understood that there may be other embodiments which fall within the scope of this disclosure and the following claims. Where a claim, if any, is expressed as a means or step for performing a specified function, it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A slider for an adjustable article of jewelry having a band, comprising:

a body defining a securing channel and a sliding channel;

a wall of the body located between the securing channel and the sliding channel such that the securing channel and the sliding channel remain separate throughout an entire length of the body, the securing channel including an open end for receiving the band and a closed end at an end of the body; and a securing flap extending from the body and configured to be pressed from an open first position to a closed second position such that the securing flap is pressed at least partially into the securing channel to restrain the band when the band is disposed therein;

wherein the sliding channel is adapted to resist motion of the band via compressive forces from the sliding channel pressing against the band when the band is disposed therein.

2. The slider of claim 1, wherein the securing flap includes one or more protrusions extending therefrom.

3. The slider of claim 2, wherein, in the second position, the one or more protrusions pierce into the band.

4. The slider of claim 2, wherein the one or more protrusions are conical teeth.

5. The slider of claim 1, wherein the sliding channel is parallel with the securing channel.

6. The slider of claim 1, wherein the sliding channel has a diameter that is smaller than the band to resist sliding via compressive forces from walls that define the sliding channel pressing against the band.

7. The slider of claim 1, wherein the body and the securing flap are integrally formed.

8. The slider of claim 7, wherein the slider is made via casting.

9. The slider of claim 7, wherein the securing channel is longitudinally defined through the body, wherein the securing flap is defined from an end of the body along a portion of a longitudinal length of the body.

10. The slider of claim 7, wherein the securing flap is defined in a middle portion of the body over the securing channel and along a portion of a longitudinal length of the body.

11. The slider of claim 1, wherein the band is disposed in the securing channel and in the sliding channel.

12. A first slider for an adjustable article of jewelry having a band, comprising:

a body defining a securing channel and a sliding channel, the sliding channel being parallel with the securing channel, the sliding channel defining a through channel with opposite open ends; and a securing flap extending from the body and configured to be pressed from an open first position to a closed second position such that the securing flap is pressed at least partially into the securing channel to restrain the band when the band is disposed therein, wherein the sliding channel is free of the securing flap being pressed therein, wherein the securing channel is adapted to receive the band along a sliding direction, and wherein the sliding channel is adapted to resist motion of the band via compressive forces from the sliding channel pressing against the band when the band is disposed therein, and wherein the body comprises a length parallel to the sliding direction and the securing flap comprises a length parallel to the sliding direction, the length of the securing flap being smaller than the length of the body.

13. The first slider of claim 12, wherein the securing flap includes one or more protrusions extending therefrom.

14. The first slider of claim 13, wherein, in the second position, the one or more protrusions are configured to pierce into the band.

15. The first slider of claim 13, wherein the one or more protrusions are conical teeth.

16. The first slider of claim 12, wherein the article of jewelry is at least one of a necklace, a bracelet, or an anklet.

17. The first slider of claim 12, wherein the band has a diameter that is larger than the sliding channel to reduce sliding via compressive forces from walls that define the sliding channel pressing against the band.

18. The first slider of claim 12, wherein the band is disposed in the securing channel and in the sliding channel.

19. The first slider of claim 12, wherein the securing flap extends in the sliding direction from a first end to a second end and the body extends in the sliding direction from a first end to a second end, wherein the first end of the securing flap is disposed at the first end of the body.

20. A method for manufacturing adjustable jewelry, comprising:

disposing a band within a securing channel of a body of a slider element and within a sliding channel of the body of the slider element, the body defining a securing channel and a sliding channel, a wall of the body located between the securing channel and the sliding channel such that the securing channel and the sliding channel remain separate throughout an entire length of the body, the securing channel including an open end for receiving the band and a closed end at an end of the body; and pressing a securing flap from an open first position to a closed second position onto the band such that the securing flap is pressed at least partially into the securing channel to secure the band within the securing channel, the securing flap extending from the body;

wherein the sliding channel is adapted to resist motion of the band via compressive forces from the sliding channel pressing against the band when the band is disposed therein.

* * * * *